US007955474B2

(12) United States Patent
Ewald et al.

(10) Patent No.: US 7,955,474 B2
(45) Date of Patent: Jun. 7, 2011

(54) TUBE BANK APPARATUS FOR DISTRIBUTING STOCK

(75) Inventors: James Leroy Ewald, Stuart, FL (US); Gregory Michael Welcher, Rockton, IL (US)

(73) Assignee: Paperchine Inc., Rockton, IL (US)

( * ) Notice: Subject to any disclaimer, the term of this patent is extended or adjusted under 35 U.S.C. 154(b) by 285 days.

(21) Appl. No.: 12/316,369

(22) Filed: Dec. 11, 2008

(65) Prior Publication Data

US 2009/0218064 A1 Sep. 3, 2009

Related U.S. Application Data

(60) Provisional application No. 61/007,149, filed on Dec. 11, 2007.

(51) Int. Cl.
*D21F 1/06* (2006.01)

(52) U.S. Cl. ..... 162/343

(58) Field of Classification Search ..... 162/343, 162/336, 212, 216
See application file for complete search history.

(56) References Cited

U.S. PATENT DOCUMENTS

| | | | | |
|---|---|---|---|---|
| 5,183,537 | A * | 2/1993 | Hergert et al. | 162/216 |
| 5,196,091 | A * | 3/1993 | Hergert | 162/258 |
| 5,626,722 | A * | 5/1997 | Huovila | 162/343 |
| 5,792,321 | A * | 8/1998 | Aidun | 162/216 |
| 6,406,595 | B1 * | 6/2002 | Aidun | 162/216 |
| 6,610,175 | B2 * | 8/2003 | Aidun | 162/336 |
| 6,675,344 | B1 * | 1/2004 | Sharma | 714/763 |
| 6,902,651 | B2 * | 6/2005 | Fujiki et al. | 162/343 |
| 2003/0178167 | A1 * | 9/2003 | Fujiki et al. | 162/212 |

* cited by examiner

*Primary Examiner* — Mark Halpern
(74) *Attorney, Agent, or Firm* — David J. Archer

(57) ABSTRACT

A tube bank apparatus is disclosed for distributing stock in a headbox of a papermaking machine. The apparatus includes a tube having a first and a second portion for the flow therethrough of the stock. The first portion defines a bore for the flow therethrough of the stock, the bore having an upstream and a downstream end. The second portion defines a passage for the flow therethrough of the stock, the passage having an upstream and a downstream extremity. The upstream extremity of the passage cooperates with the downstream end of the bore so that the stock flows from the upstream end to the downstream end of the bore and then through the upstream extremity and then the downstream extremity of the passage. The downstream end of the bore has a cross-sectional area which is less than a further cross-sectional area of the upstream extremity of the passage. Also, the downstream extremity of the passage has a cross-section of trapezoidal configuration.

19 Claims, 11 Drawing Sheets

TUBE BANK APPARATUS FOR DISTRIBUTING STOCK

CROSS REFERENCE TO RELATED APPLICATION

The subject application is a Complete application filed pursuant to the Provisional application U.S. Ser. No. 61/007,149 filed Dec. 11, 2007. All the disclosure of the aforementioned Provisional application U.S. Ser. No. 61/007,149 is incorporated herein by reference.

BACKGROUND OF THE INVENTION

1. Field of the Invention

The present invention relates to a tube bank apparatus for distributing stock.

More specifically, the present invention relates to a tube bank apparatus for distributing stock in a headbox of a papermaking machine.

2. Background Information

A conventional headbox distributor uses a tube array to spread the pulp slurry as uniformly as possible across the width of a paper machine headbox prior to the start of the drainage or other thickening process. The tube array is made up of individual round inlet tubes mounted in some manner to cause acceleration of the flow into each tube from a cross machine header or other form of supply of the slurry prior to the tube array. The pressure drop from the acceleration of the flow at the inlet of each tube within the array is critical to the uniformity of the flow within each tube and therefore to the uniformity of the cross machine uniformity of the headbox in general. This acceleration of the flow is also a factor in the operational cleanliness of the headbox operation. The exit end of a typical tube array may take on many shapes but eventually the flows exiting each individual tube must be re-joined prior to or within the nozzle of the headbox prior to discharge to the drainage area. The reorientation of the round tube entrance flow to the eventual rectangular shape of the nozzle will create disturbances in the flow in all directions. These disturbances must be damped or reduced in some way prior to discharge out the slice so as not to cause nonuniformities in the paper web.

The purpose of this invention is to create the necessary pressure drop and subsequent uniform cross machine flow distribution while minimizing the wall effects of the individual tubes prior to the rejoining of the flows in the nozzle. According to the present invention, the discharge end of each tube is of a trapezoidal shape with alternate tube trapezoid shapes vertically opposite each other. These trapezoidal shaped tubes are nested together to form a close packed array on the discharge end, with little or no vertical wall continuous in any area across the width of the headbox. To make the edge effect minimal to the pond sides a special tube can be supplied on each end which has one side the same angle as the two sides of the trapezoidal discharges and the other side vertical. This tube may be larger in the discharge area than the rest of the tubes and subsequently may have a larger inlet as well. This larger inlet may have an adjustable insert for flow and fiber orientation control as well.

The invention uses a distributor consisting of simple round inlet tubes expanding to a round expansion area then to a trapezoidal area with a cross-sectional area similar to a cross-sectional area of the round expansion area. This round to trapezoid allows for some acceleration of the flow toward the discharge of the tube, yet minimizes the vertical open area change between tubes by slanting the wall area between tubes. This invention will reduce cross machine non uniformity of both consistency and velocity of the stock flow. This invention is useful for all grades of paper or tissue, and is usable with or without the inclusion of flow turbulence control sheets. The apparatus according to the present invention is usable with or without the use of consistency dilution control. This invention is adaptable for using different entrance diameters of the tube array which will alter the in-going velocities.

Therefore, the primary feature of the present invention is the provision of a tube bank apparatus for distributing stock in a headbox of a papermaking machine that overcomes the problems associated with the prior art arrangements and which makes a significant contribution to the papermaking art.

Another feature of the present invention is the provision of a tube bank apparatus for distributing stock in a headbox of a papermaking machine that reduces cross machine non uniformity of both consistency and velocity.

Yet another feature of the present invention is the provision of a tube bank apparatus for distributing stock in a headbox of a papermaking machine that increase the operational cleanliness of the headbox operation.

Other features and advantages of the present invention will be readily apparent to those skilled in the art by a consideration of the detailed description of a preferred embodiment of the present invention contained herein.

SUMMARY OF THE INVENTION

The present invention relates to a tube bank apparatus for distributing stock in a headbox of a papermaking machine. The apparatus includes a tube having a first and a second portion for the flow therethrough of the stock. The first portion defines a bore for the flow therethrough of the stock, the bore having an upstream and a downstream end. The second portion defines a passage for the flow therethrough of the stock, the passage having an upstream and a downstream extremity. The upstream extremity of the passage cooperates with the downstream end of the bore so that the stock flows from the upstream end to the downstream end of the bore and then through the upstream extremity and then the downstream extremity of the passage. The downstream end of the bore has a cross-sectional area which is less than a further cross-sectional area of the upstream extremity of the passage. Also, the downstream extremity of the passage has a cross-section of trapezoidal configuration.

In a more specific embodiment of the present invention, the tube is fabricated from metal.

More specifically, the tube is fabricated from stainless steel.

Additionally, the bore is of uniform cross-sectional area from the upstream end to the downstream end thereof.

Also, the bore is of circular cross-section from the upstream end to the downstream end thereof.

The upstream extremity of the passage is of circular cross-sectional configuration and the circular cross-sectional configuration of the upstream extremity has an area approximately equal to a further area of the cross-section of trapezoidal configuration.

Furthermore, the trapezoidal configuration of the downstream extremity of the passage includes a first, second, third and fourth edge. The second and fourth edges have lengths that are approximately equal to each other.

Also, the first and third edges are disposed approximately parallel relative to each other.

Additionally, an angle defined between the first edge and the second edge is approximately equal to a further angle defined between the first edge and the fourth edge.

A plurality of further tubes is provided with each further tube being substantially identical in configuration to the tube.

The tube and a laterally adjacent further tube of the plurality of further tubes are nested relative to each other with the further tube being inverted relative to the tube so that any disturbances generated within each tube prior to discharge of the flow of stock from the tubes are minimized.

Moreover, the fourth edge of the tube is disposed congruently adjacent to the second edge of the adjacent further tube.

Additionally, the tube and further tubes define a row of tubes.

A further row of tubes is provided substantially identical to the row of tubes. The further row is disposed parallel and adjacent to the row of tubes and at a different elevation relative to the row of tubes. The arrangement is such that a first edge of a tube of the row of tubes is disposed spaced and parallel relative to a third edge of an adjacent tube of the further row of tubes.

Also, an edge tube has a first and a second part for the flow therethrough of the stock. The first part defines a channel for the flow therethrough of the stock. The channel has an upstream and a downstream termination.

The second part of the edge tube defines a conduit for the flow therethrough of the stock. The conduit has an upstream and a downstream boundary. The upstream boundary of the conduit cooperates with the downstream termination of the channel so that the stock flows from the upstream termination to the downstream termination of the channel and then through the upstream boundary and then the downstream boundary of the conduit.

Also, the downstream termination of the channel has a cross-sectional area which is less than a further cross-sectional area of the upstream boundary of the conduit.

Furthermore, the downstream boundary of the conduit has a cross-section of trapezoidal configuration.

Also, the upstream termination of the edge tube has a larger cross sectional area than the cross sectional area of the upstream end of the tube or further tubes.

The downstream boundary of the conduit includes a first, second third and fourth side. The first and third sides are disposed spaced and parallel relative to each other.

Additionally, the second side defines a first angle relative to the first side.

Also, the fourth side defines a second angle relative to the first side. The first and second angles are different from each other so that the edge tube nests between a pond side of the headbox and an adjacent edge of an adjacent tube.

An adjustable insert is disposed within the upstream termination for adjustably restricting the flow through the edge tube for controlling the flow and fiber orientation downstream relative to the tube bank apparatus.

A dilution control apparatus is operatively connected to the tube bank apparatus for controlling the consistency of stock flowing through at least some of the tubes of the tube bank apparatus for thus reducing the cross machine nonuniformities in consistency of a resultant web.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
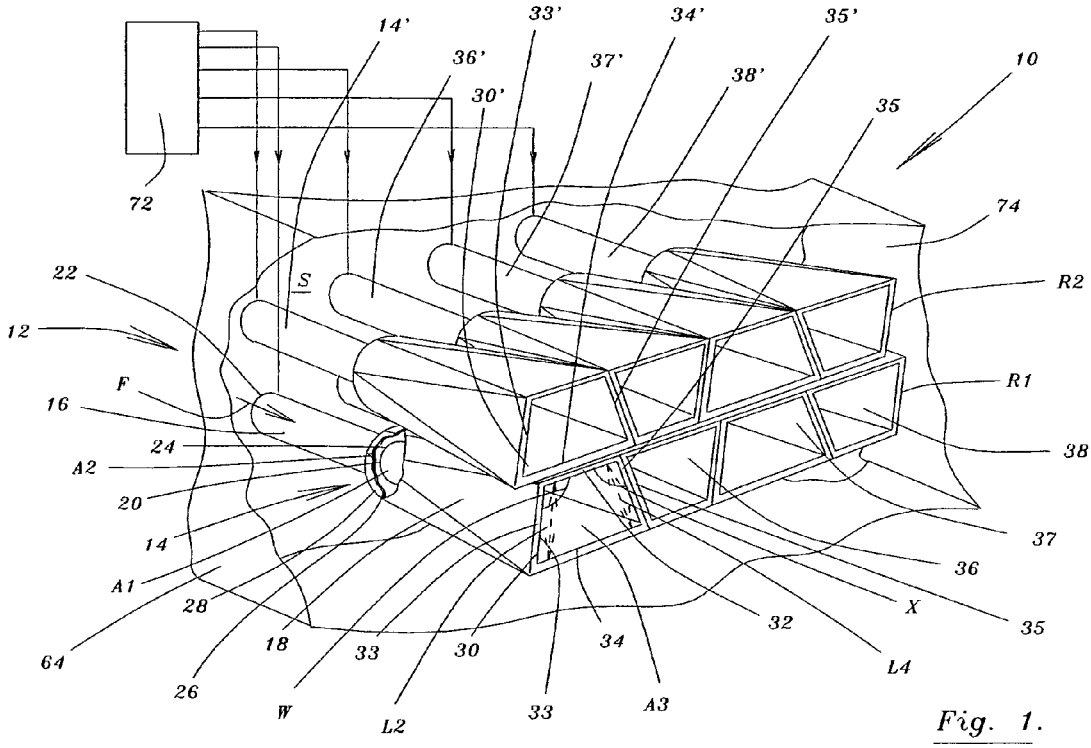
FIG. 1 is a perspective view of a tube bank apparatus according to the present invention for distributing stock in a headbox of a papermaking machine.

FIG. 1 is a perspective view of a tube bank apparatus generally designated 10 for distributing stock S in a headbox generally designated 12 of a papermaking machine. The apparatus 10 includes a tube generally designated 14 having a first and a second portion 16 and 18 respectively for the flow therethrough of the stock S as indicated by the arrow F. The first portion 16 defines a bore 20 for the flow F therethrough of the stock S, the bore 20 having an upstream end 22 and a downstream end 24. The second portion 18 defines a passage 26 for the flow F therethrough of the stock S, the passage 26 having an upstream extremity 28 and a downstream extremity 30. The upstream extremity 28 of the passage 26 cooperates with the downstream end 24 of the bore 20 so that the stock S flows as indicated by the arrow F from the upstream end 22 to the downstream end 24 of the bore 20 and then through the upstream extremity 28 and then the downstream extremity 30 of the passage 26. The downstream end 24 of the bore 20 has a cross-sectional area A1 which is less than a further cross-sectional area A2 of the upstream extremity 28 of the passage 26. Also, the downstream extremity 30 of the passage 26 has a cross-section A3 of trapezoidal configuration.

In a more specific embodiment of the present invention, the tube 14 is fabricated from metal.

More specifically, the tube 14 is fabricated from stainless steel.

Additionally, the bore 20 is of uniform cross-sectional area A1 from the upstream end 22 to the downstream end 24 thereof.

Also, the bore 20 is of circular cross-section from the upstream end 22 to the downstream end 24 thereof.

The upstream extremity 28 of the passage 26 is of circular cross-sectional configuration A2 and the area A2 of the circular cross-sectional configuration of the upstream extremity 28 is approximately equal to the cross sectional area A3 of the downstream extremity 30 which is of trapezoidal cross-sectional configuration.

Furthermore, the trapezoidal configuration of the downstream extremity 30 of the passage 26 includes a first edge 32, second edge 33, third edge 34 and fourth edge 35. The second edge 33 and fourth edges 35 have lengths L2 and L4 respectively that are approximately equal to each other.

Also, the first edge 32 and third edge 34 are disposed approximately parallel relative to each other.

Additionally, an angle W defined between the first edge 32 and the second edge 33 is approximately equal to a further angle X defined between the first edge 32 and the fourth edge 35.

A plurality of further tubes 36, 37 and 38 is provided with each further tube 36-38 being substantially identical in configuration to the tube 14.

The tube 14 and a laterally adjacent further tube 36 of the plurality of further tubes 36-38 are nested relative to each other with the further tube 36 being inverted relative to the tube 14 so that any disturbances generated within each tubes 14 and 36-38 prior to discharge of the flow F of stock S from the tubes 14 and 36-38 is minimized when the stock exits the tubes.

Moreover, the fourth edge 35 of the tube 14 is disposed congruently adjacent to the fourth edge 35 of the adjacent further tube 36.

Additionally, the tube 14 and further tubes 36-38 define a row R1 of tubes 14 and 36-38.

A further row R2 of tubes $\mathbf{14}^1$ and $\mathbf{36}^1$-$\mathbf{38}^1$ is substantially identical to the row R1 of tubes 14 and 36-38. The further row R2 is disposed parallel and adjacent to the row R1 of tubes 14 and 36-38 and at a different elevation relative to the row R1 of tubes 14 and 36-38. The arrangement is such that the first edge 32 of a tube such as 14 of the row R1 of tubes 14 and 36-38 is disposed spaced and parallel relative to a third edge $\mathbf{34}^1$ of an adjacent tube such as $\mathbf{14}^1$ of the further row R2 of tubes. $\mathbf{14}^1$ and $\mathbf{36}^1$-$\mathbf{38}^1$.

Figure 2:
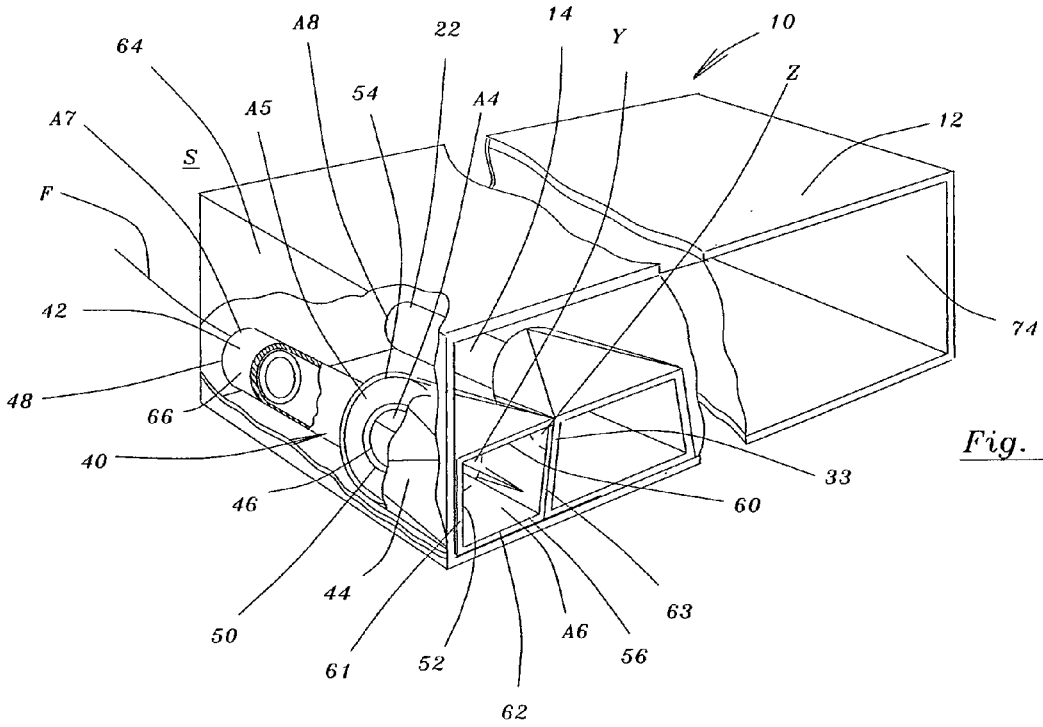
FIG. 2 is a perspective view partially in section of the tube bank apparatus shown in FIG. 1.

FIG. 2 is a perspective view partially in section of the tube bank apparatus 10 shown in FIG. 1. As shown in FIG. 2, the apparatus 10 also includes an edge tube generally designated 40 which has a first part 42 and a second part 44 for the flow F therethrough of the stock S. The first part 42 defines a channel 46 for the flow F therethrough of the stock S. The channel 46 has an upstream termination 48 and a downstream termination 50.

The second part 44 defines a conduit 52 for the flow F therethrough of the stock S. The conduit 52 has an upstream boundary 54 and a downstream boundary 56. The upstream boundary 54 of the conduit 52 cooperates with the downstream termination 50 of the channel 46 so that the stock S flows as indicated by the arrow F from the upstream termination 48 to the downstream termination 50 of the channel 46 and then through the upstream boundary 54 and then the downstream boundary 56 of the conduit 52.

Also, the downstream termination 50 of the channel 46 has a cross-sectional area A4 which is less than a further cross-sectional area A5 of the upstream boundary 54 of the conduit 52.

Furthermore, the downstream boundary 56 of the conduit 52 has a cross-sectional area A6 of trapezoidal configuration.

Also, the upstream termination 48 of the edge tube 40 has a cross sectional area A7 which is larger than a cross sectional area A8 of the upstream end 22 of the bore 20 of the tube 14.

The downstream boundary 56 of the conduit 52 includes a first side 60, second side 61, third side 62 and fourth side 63. The first side 60 and third side 62 are disposed spaced and parallel relative to each other.

Additionally, the second side 61 defines a first angle Y relative to the first side 60.

Also, the fourth side 63 defines a second angle Z relative to the first side 60. The first angle Y and the second angle Z are different from each other so that the edge tube 40 nests between a pond side 64 of the headbox 12 and an adjacent edge 33 of an adjacent tube 14.

More specifically, the second side 61 of the edge tube 40 is vertical so that it cooperates and lies flat against the pond side 64. Also, the fourth side 63 is not vertical so that the fourth side 63 or wall cooperates with the second edge 33 of the tube 14 thereby minimizing the wall effect of the edge tube 40 and the tube 14 when the stock S exits from the tubes 40 and 14.

As shown in FIG. 2, an adjustable insert 66 is disposed within the upstream termination 48 of the edge tube 40 for adjustably restricting a flow as indicated by the arrow F through the edge tube 40 for controlling the flow and the fiber orientation downstream relative to the tube bank apparatus 10.

As shown in FIG. 1, a dilution control apparatus 72 is provided. The dilution control is of the type disclosed in U.S. Pat. No. 5,196,091. The dilution control apparatus 72 is operatively connected to the tube bank apparatus 10 for controlling the consistency of stock S flowing through at least some of the tubes 14-36-38 and $\mathbf{14}^1$ and $\mathbf{36}^1$-$\mathbf{38}^1$ of the tube bank apparatus 10 for thus enhancing a uniformity of the cross machine basis weight of a resultant web. All of the disclosure of U.S. Pat. No. 5,196,091 is incorporated herein by reference.

Although, in a preferred embodiment of the present invention, the tube bank apparatus includes two rows R1 and R2 of tubes, those skilled in the art will appreciate that the tube bank apparatus could include a single row only of tubes. Alternatively, the tube bank apparatus could include more than two rows of tubes.

Figure 3:
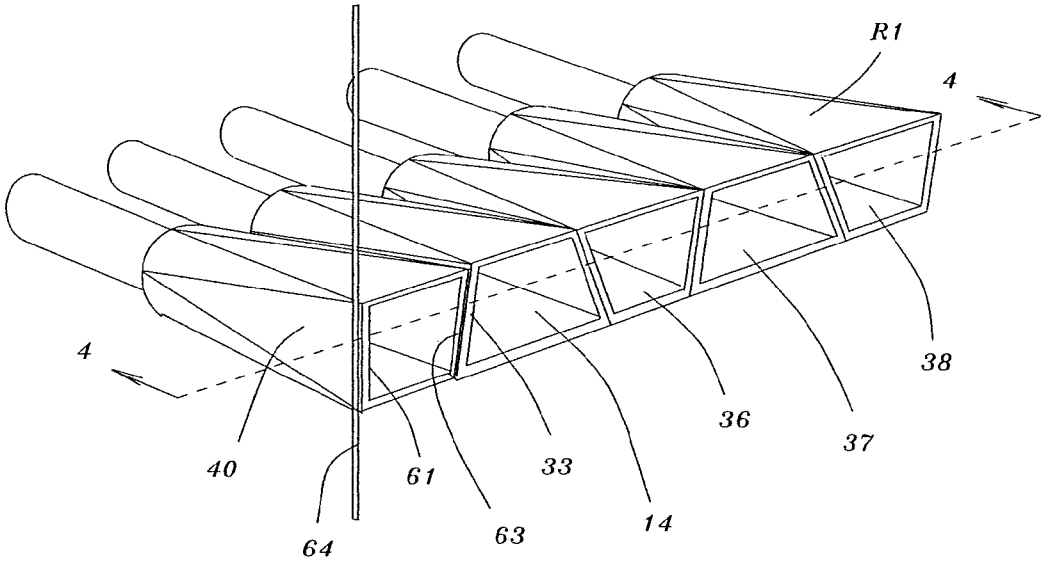
FIG. 3 is a perspective view of the row of tubes shown in FIGS. 1 and 2.

FIG. 3 is a perspective view of the row R1 shown in FIGS. 1 and 2. As shown in FIG. 3, the row R1 includes edge tube 40 with the vertical side or wall 61 which mates with the vertical wall of the pond side 64. FIG. 3 also shows the cooperating wall or side 63 of the tube 40 and the wall or edge 33 of the tube 14 being non vertical.

Figure 4:
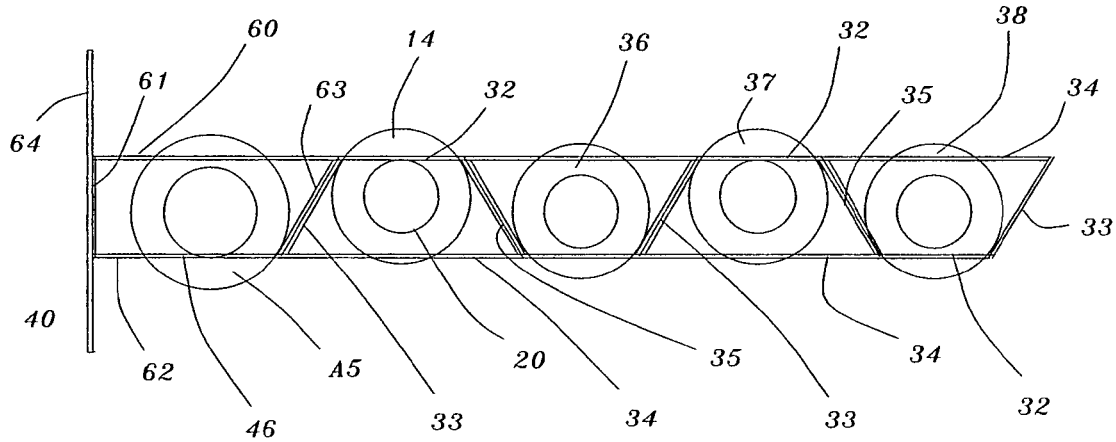
FIG. 4 is a view taken on the line 4-4 of FIG. 3.

FIG. 4 is a view taken on the line 4-4 of FIG. 3. As shown in FIG. 4, the second side 61 of the tube 40 lays flat against the pond side 64.

Figure 5:
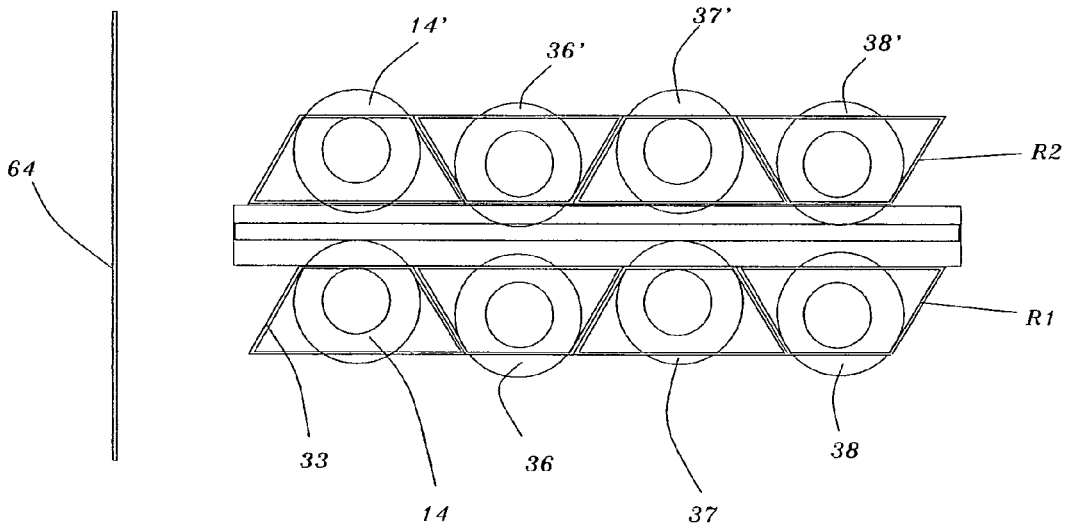
FIG. 5 is a similar view to that shown in FIG. 4 but with the edge tubes not shown.

FIG. 5 is a similar view to that shown in FIG. 4 but with the edge tubes 40 not shown. FIG. 5 also shows the arrangement of the two rows of tubes R1 and R2.

Figure 6:
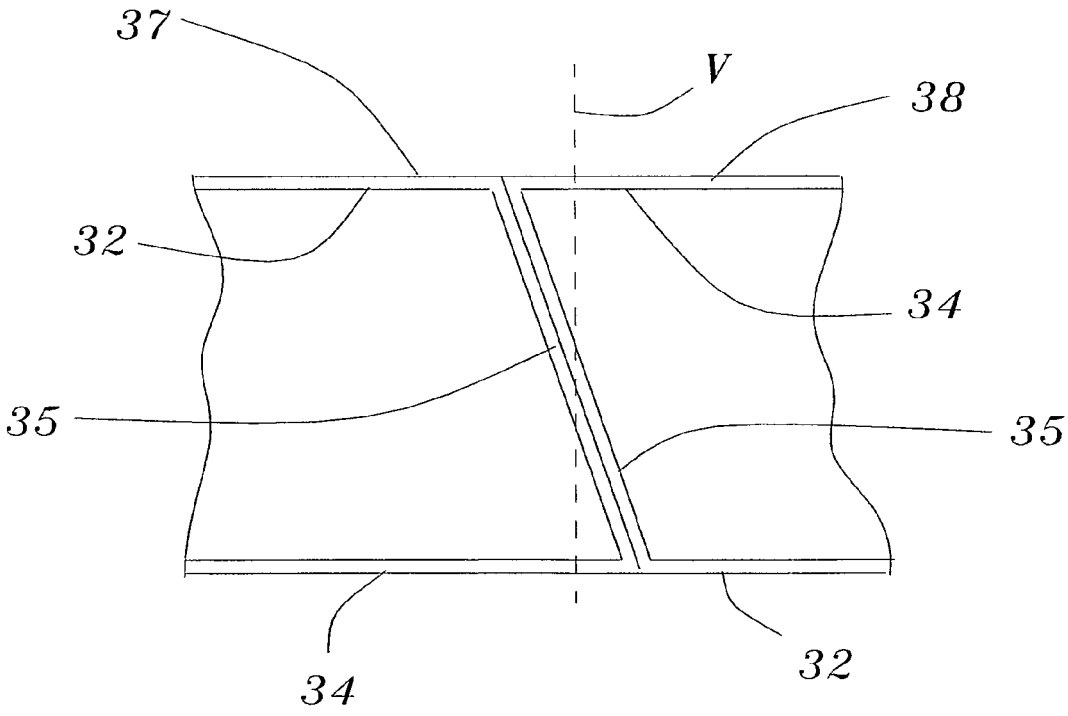
FIG. 6 is an enlarged view of a portion of the arrangement shown in FIGS. 4 and 5 showing further tubes with adjacent edges respectively cooperating with each other and being angularly disposed relative to the vertical line and the pond side.

FIG. 6 is an enlarged view of a portion of the arrangement shown in FIGS. 4 and 5. As shown in FIG. 6, the further tubes 37 and 38 with adjacent edges 35 and 35 respectively cooperate with each other and are angularly disposed relative to the vertical line V and the pond side 64.

Figure 7:
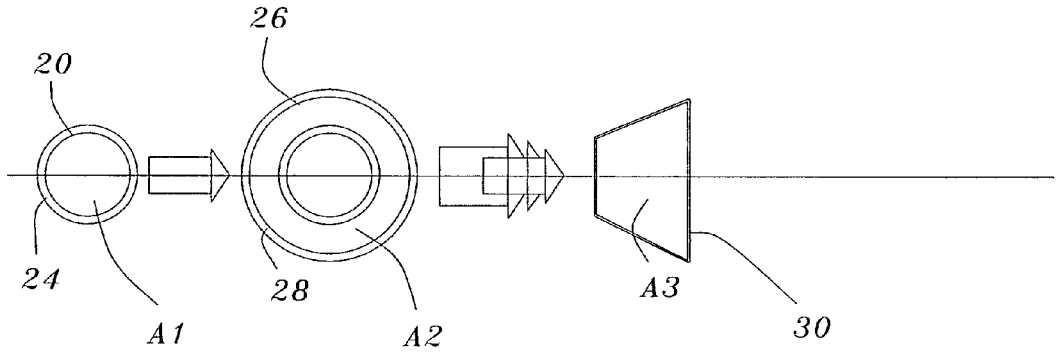
FIG. 7 is a diagrammatic view of one of the tubes of the tube bank apparatus shown in FIGS. 1-6.

FIG. 7 is a diagrammatic view of one of the tubes of the tube bank apparatus shown in FIGS. 1-6. As shown in FIG. 7, the transition from the round area A1 of the upstream and downstream ends 22 and 24 of the bore 20 to the larger round area A2 of the upstream extremity 28 of the passage 26 to the area A3 of the trapezoidal cross section 30. The area A3 is approximately the same as the area A2. The flow F from the round area A1 to the larger round area A2 causes a deceleration of the stock flow F. However, there is a slight flow acceleration from the round area A2 to the trapezoidal area A3. The area A2 being approximately the same or similar to the area A3. Therefore, the perimeter of 28 and 30 are approximately the same in length.

Figure 8:
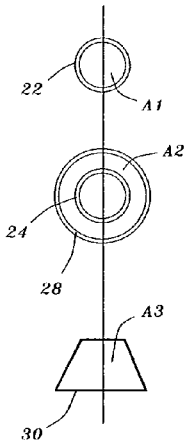
FIG. 8 is a diagram to show the transition from area A1 to A2 and then to A3.

FIG. 8 is a diagram to show the transition from the area A1 to A2 and then to A3.

Figure 9:
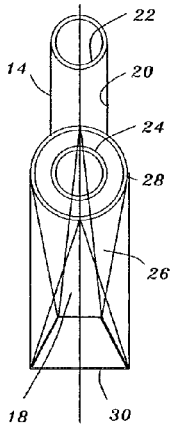
FIG. 9 is a top view of the tube shown in FIG. 1 showing how the second portion is transformed from a round section to a trapezoidal section.

FIG. 9 is a top view of the tube 14. As shown in FIG. 9, the second portion 18 is transformed from a round section 28 to a trapezoidal section 30.

Figure 10:
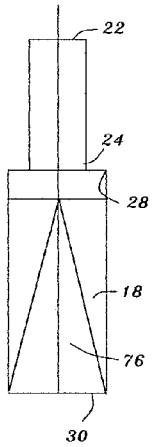
FIG. 10 shows the first stage in the transformation of the second portion from a round section to a trapezoidal configuration.

FIG. 10 shows the first stage in the transformation of the second portion 18 from a round section 28 to a trapezoidal configuration 30 by pressing inwardly the area 76.

Figure 11:
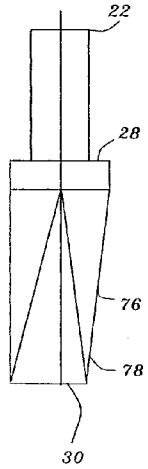
FIG. 11 is a view of the tube shown in FIG. 10 but turned through 90 degrees.

FIG. 11 is a view of the tube shown in FIG. 10 but turned through 90 degrees. FIG. 11 shows the effect of pressing the area 76. The area 78 is then pressed inwardly.

Figure 12:
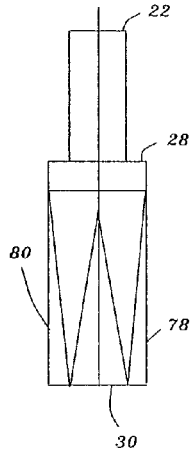
FIG. 12 is similar to the view shown in FIG. 10 after the pressing of the area shown in FIG. 11.

FIG. 12 is similar to the view shown in FIG. 10 after the pressing of the area 78 shown in FIG. 11 and the area 80 disposed opposite to the area 78.

Figure 13:
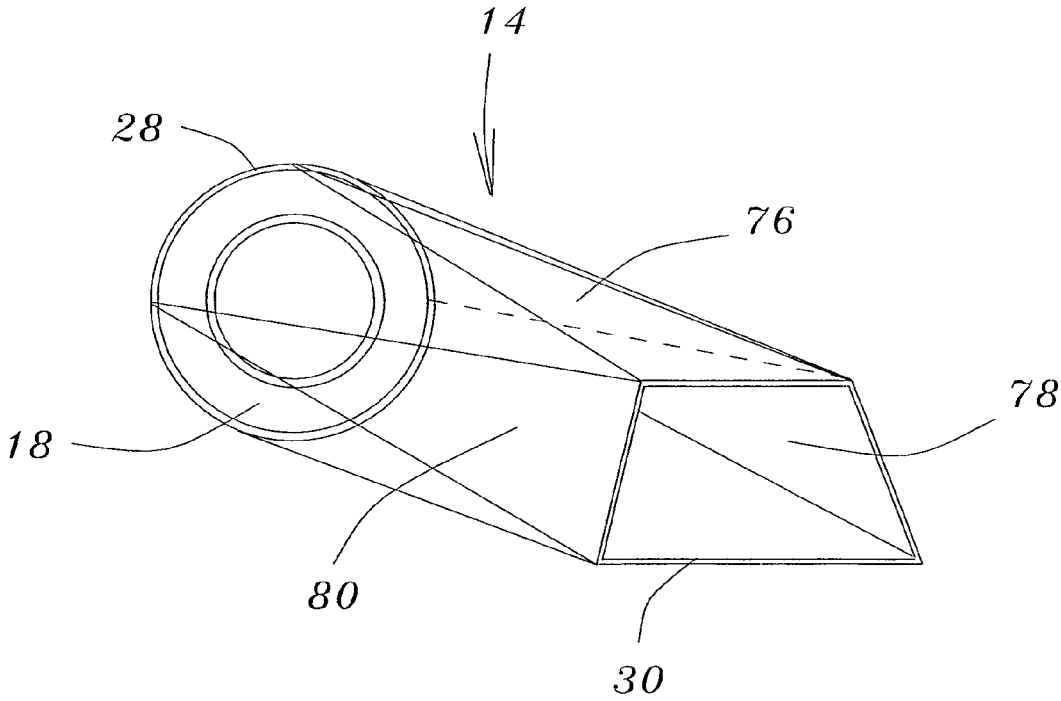
FIG. 13 is a perspective view of the second portion of the tube.

FIG. 13 is a perspective view of the second portion 18 of the tube 14. FIG. 13 shows the effect of pressing the area 76 and the areas 78 and 80 to transform the round section 28 to a section of trapezoidal configuration 30.

Figure 14:
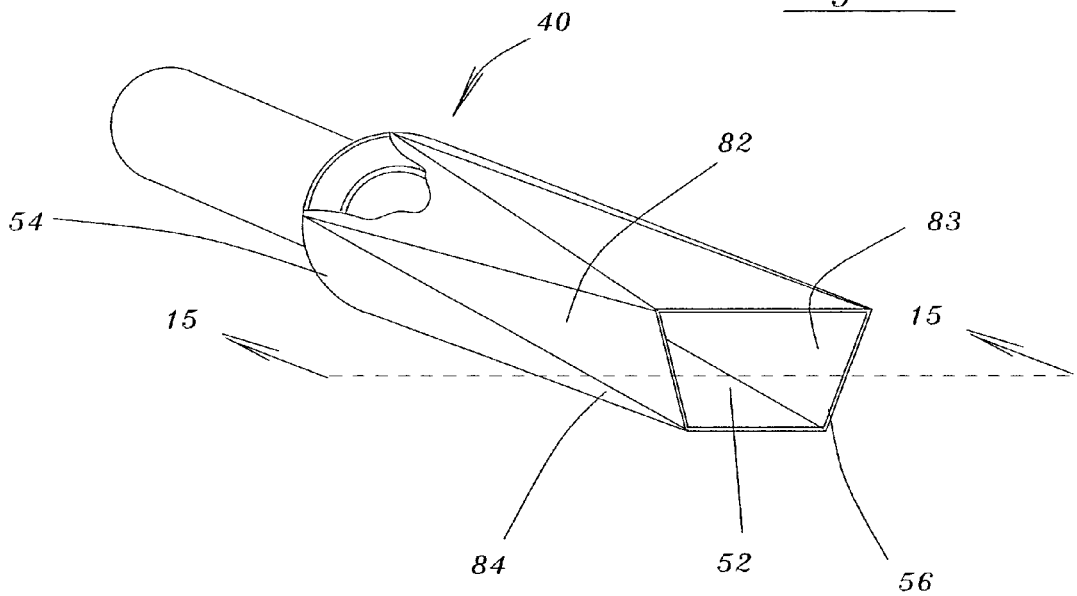
FIG. 14 is a perspective view of the edge tube.

FIG. 14 is a perspective view of the edge tube 40. FIG. 14 shows how the areas 82, 83 and 84 are pressed to convert the round section of the upstream boundary 54 of the conduit 52 to a section of trapezoidal configuration at the downstream boundary 56.

Figure 15:
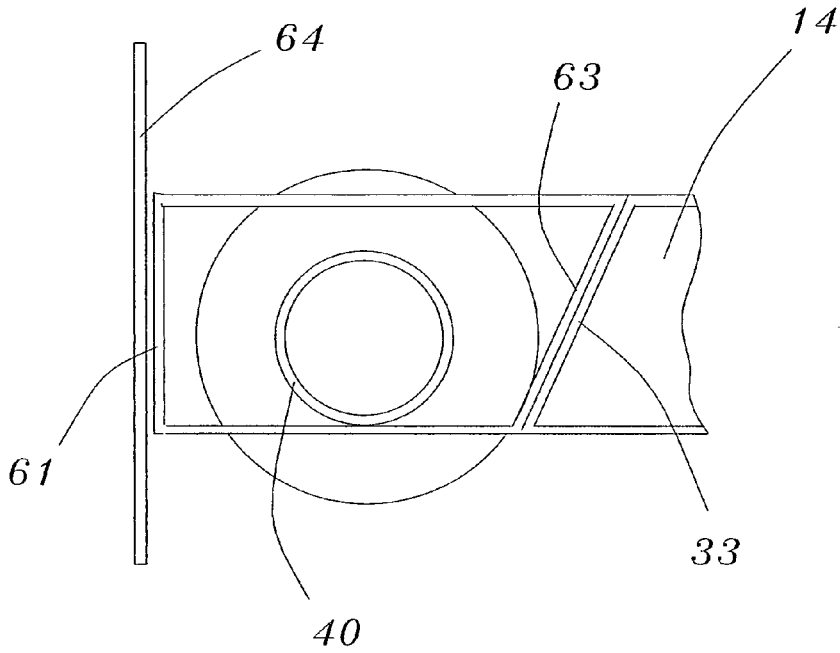
FIG. 15 is a view taken on the line 15-15 of FIG. 14.

FIG. 15 is a view taken on the line 15-15 of FIG. 14. As shown in FIG. 15, the second side 61 of the edge tube 40 cooperates with the pond side 64. The fourth side 63 cooperates with the edge 33 of the tube 14.

In operation of the tube bank apparatus 10, pressurized stock S flows through the upstream end 22 and $\mathbf{22}^1$ of each tube 14-36-38 and $\mathbf{14}^1$ and $\mathbf{36}^1$-$\mathbf{38}^1$ of the tube bank apparatus 10. The stock S also flows through the edge tube 40 disposed adjacent to the pond side 64. Stock S will also flow through a corresponding edge tube (not shown) disposed on the opposite pond side 74 of the headbox 12.

Due to the trapezoidal shape of the downstream extremities 30 and $\mathbf{30}^1$ of the tubes 14-36-38 and $\mathbf{14}^1$ and $\mathbf{36}^1$-$\mathbf{38}^1$, the second edge 33 and $\mathbf{33}^1$ and fourth edge 35 and $\mathbf{35}^1$ will not be disposed parallel to each other or to the pond sides 64 and 74 of the headbox 12. Consequently, the wall effects of the individual tubes 14-36-38 and $\mathbf{14}^1$ and $\mathbf{36}^1$-$\mathbf{38}^1$ on the distribution of the stock S on exiting the tubes 14-36-38 and $\mathbf{14}^1$ and $\mathbf{36}^1$-$\mathbf{38}^1$ will be minimized.

Additionally, by providing the edge tubes 40 with at least one side such as side 63 with a disposition that is not parallel to the pond side 64, any edge effect caused by flow of stock out of the edge tube 40 is also minimized.

The present invention provides a unique headbox tube bank apparatus which minimizes the wall effect of the tubes and the side effect of the tubes and edge tubes on stock flowing out of the tubes.

What is claimed is:

1. A tube bank apparatus for distributing stock in a headbox of a papermaking machine, said apparatus comprising:

a tube having a first and a second portion for the flow therethrough of the stock;

said first portion defining a bore for the flow therethrough of the stock, said bore having an upstream and a downstream end;

said second portion defining a passage for the flow therethrough of the stock, said passage having an upstream and a downstream extremity, said upstream extremity of said passage cooperating with said downstream end of said bore so that the stock flows from said upstream end to said downstream end of said bore and then through said upstream extremity and then said downstream extremity of said passage;

said downstream end of said bore having a cross-sectional area which is less than a further cross-sectional area of said upstream extremity of said passage; and said downstream extremity of said passage having a cross-section of trapezoidal configuration for minimizing wall effect of the tubes and side effect of the tubes and edge tubes on stock flowing out of the tubes of said tube bank apparatus.

2. A tube bank apparatus as set forth in claim 1 wherein said tube is fabricated from metal.

3. A tube bank apparatus as set forth in claim 1 wherein said tube is fabricated from stainless steel.

4. A tube bank apparatus as set forth in claim 1 wherein said bore is of uniform cross-sectional area from said upstream end to said downstream end thereof.

5. A tube bank apparatus as set forth in claim 1 wherein said bore is of circular cross-section from said upstream end to said downstream end thereof.

6. A tube bank apparatus as set forth in claim 5 wherein said bore is of uniform cross-sectional area from said upstream end to said downstream end thereof.

7. A tube bank apparatus as set forth in claim 1 wherein said upstream extremity of said passage is of circular cross-sectional configuration.

8. A tube bank apparatus as set forth in claim 7 wherein said circular cross-sectional configuration of said upstream extremity has an area approximately equal to a further area of said cross-section of trapezoidal configuration.

9. A tube bank apparatus as set forth in claim 1 wherein said trapezoidal configuration of downstream extremity of said passage includes:

a first, second, third and fourth edge;

said second and fourth edges having lengths that are approximately equal to each other.

10. A tube bank apparatus as set forth in claim 9 wherein said first and third edges are disposed approximately parallel relative to each other.

11. A tube bank apparatus as set forth in claim 9 wherein an angle defined between said first edge and said second edge is approximately equal to a further angle defined between said first edge and said fourth edge.

12. A tube bank apparatus as set forth in claim 11 further including:

a plurality of further tubes, each further tube being substantially identical in configuration to said tube;

said tube and a laterally adjacent further tube of said plurality of further tubes being nested relative to each other with said further tube being inverted relative to said tube so that any disturbances generated within each tube prior to discharge of the flow of stock from said tubes is minimized on flowing out from said tubes.

13. A tube bank apparatus as set forth in claim 12 wherein said fourth edge of said tube is disposed congruently adjacent to said second edge of said adjacent further tube.

14. A tube bank apparatus as set forth in claim 1 wherein said tube and further tubes define a row of tubes;

a further row of tubes substantially identical to said row of tubes, said further row being disposed parallel and adjacent to said row of tubes and at a different elevation relative to said row of tubes such that a first edge of a tube of said row of tubes is disposed spaced and parallel relative to a third edge of an adjacent tube of said further row of tubes.

15. A tube bank apparatus as set forth in claim 1 further including:

an edge tube having a first and a second part for the flow therethrough of the stock;

said first part defining a channel for the flow therethrough of the stock, said channel having an upstream and a downstream termination;

said second part of said edge tube defining a conduit for the flow therethrough of the stock, said conduit having an upstream and a downstream boundary, said upstream boundary of said conduit cooperating with said downstream termination of said channel so that the stock flows from said upstream termination to said downstream termination of said channel and then through said upstream boundary and then said downstream boundary of said conduit;

said downstream termination of said channel having a cross-sectional area which is less than a further cross-sectional area of said upstream boundary of said conduit;

said downstream boundary of said conduit having a cross-section of trapezoidal configuration;

said upstream termination of said edge tube having a larger cross sectional area than said cross sectional area of said upstream end of said tube;

said downstream boundary of said conduit including:

a first, second third and fourth side;

said first and third side being disposed spaced and parallel relative to each other;

said second side defining a first angle relative to said first side;

said fourth side defining a second angle relative to said first side, said first and second angles being different from each other so that said edge tube nests between a pond side of the headbox and an adjacent edge of an adjacent tube.

16. A tube bank apparatus as set forth in claim 15 further including:

an adjustable insert disposed within said upstream termination for adjustably restricting the flow through said edge tube for controlling the flow and fiber orientation downstream relative to the tube bank apparatus.

17. A tube bank apparatus as set forth in claim 1 further including:

a dilution control apparatus operatively connected to said tube bank apparatus for controlling the consistency of stock flowing through at least some of the tubes of said tube bank apparatus for thus enhancing a uniformity of a cross machine basis weight of a resultant web.

18. A tube bank apparatus for distributing stock in a headbox of a papermaking machine, said apparatus comprising:

a tube having a first and a second portion for the flow therethrough of the stock;

said first portion defining a bore for the flow therethrough of the stock, said bore having an upstream and a downstream end;

said second portion defining a passage for the flow therethrough of the stock, said passage having an upstream and a downstream extremity, said upstream extremity of said passage cooperating with said downstream end of said bore so that the stock flows from said upstream end to said downstream end of said bore and then through said upstream extremity and then said downstream extremity of said passage;

said downstream end of said bore having a cross-sectional area which is less than a further cross-sectional area of said upstream extremity of said passage;

said downstream extremity of said passage having a cross-section of trapezoidal configuration;

said trapezoidal configuration of downstream extremity of said passage including:

a first, second, third and fourth edge; and an angle defined between said first edge and said second edge being approximately equal to a further angle defined between said first edge and said fourth edge for minimizing wall effect of the tubes and side effect of the tubes and edge tubes on stock flowing out of the tubes of said tube bank apparatus.

19. A tube bank apparatus for distributing stock in a headbox of a papermaking machine, said apparatus comprising:

a tube having a first and a second portion for the flow therethrough of the stock;

said first portion defining a bore for the flow therethrough of the stock, said bore having an upstream and a downstream end;

said second portion defining a passage for the flow therethrough of the stock, said passage having an upstream and a downstream extremity, said upstream extremity of said passage cooperating with said downstream end of said bore so that the stock flows from said upstream end to said downstream end of said bore and then through said upstream extremity and then said downstream extremity of said passage;

said downstream end of said bore having a cross-sectional area which is less than a further cross-sectional area of said upstream extremity of said passage;

said downstream extremity of said passage having a cross-section of trapezoidal configuration;

said tube being fabricated from stainless steel;

said bore being of uniform cross-sectional area from said upstream end to said downstream end thereof;

said bore being of circular cross-section from said upstream end to said downstream end thereof;

said upstream extremity of said passage being of circular cross-sectional configuration;

said circular cross-sectional configuration of said upstream extremity having an area approximately equal to a further area of said cross-section of trapezoidal configuration;

said trapezoidal configuration of said downstream extremity of said passage including:

a first, second, third and fourth edge;

said second and fourth edges having lengths that are approximately equal to each other;

said first and third edges being disposed approximately parallel relative to each other;

an angle defined between said first edge and said second edge being approximately equal to a further angle defined between said first edge and said fourth edge;

a plurality of further tubes, each further tube being substantially identical in configuration to said tube;

said tube and a laterally adjacent further tube of said plurality of further tubes being nested relative to each other with said further tube being inverted relative to said tube so that any disturbances generated within each tube prior to discharge of the flow of stock from said tubes is minimized when the stock flows out of the tubes;

said fourth edge of said tube being disposed congruently adjacent to said fourth edge of said adjacent further tube;

said tube and further tubes defining a row of tubes;

a further row of tubes substantially identical to said row of tubes, said further row being disposed parallel and adjacent to said row of tubes and at a different elevation relative to said row of tubes such that a first edge of a tube of said row of tubes is disposed spaced and parallel relative to a third edge of an adjacent tube of said further row of tubes;

an edge tube having a first and a second part for the flow therethrough of the stock;

said first part defining a channel for the flow therethrough of the stock, said channel having an upstream and a downstream termination;

said second part defining a conduit for the flow therethrough of the stock, said conduit having an upstream and a downstream boundary, said upstream boundary of said conduit cooperating with said downstream termination of said channel so that the stock flows from said upstream termination to said downstream termination of said channel and then through said upstream boundary and then said downstream boundary of said conduit;

said downstream termination of said channel having a cross-sectional area which is less than a further cross-sectional area of said upstream boundary of said conduit;

said downstream boundary of said conduit having a cross-section of trapezoidal configuration;

said upstream termination of said channel having a larger cross sectional area than said cross sectional area of said upstream end of said tube;

said downstream boundary of said conduit including:

a first, second third and fourth side;

said first and third side being disposed spaced and parallel relative to each other;

said second side defining a first angle relative to said first side;

said fourth side defining a second angle relative to said first side, said first and second angles being different from each other so that said edge tube nests between a pond side of the headbox and an adjacent edge of an adjacent tube for minimizing wall effect of the tubes and side effect of the tubes and edge tubes on stock flowing out of the tubes of said tube bank apparatus;

an adjustable insert disposed within said upstream termination of said edge tube for adjustably restricting the flow through said edge tube for controlling the flow and fiber orientation downstream relative to tube bank apparatus; and a dilution control apparatus operatively connected to said tube bank apparatus for controlling the consistency of stock flowing through at least some of the tubes of said tube bank apparatus for thus enhancing a uniformity of the cross machine directional basis weight of a resultant web.

* * * * *